US007388593B2

(12) United States Patent
Fukuda

(10) Patent No.: US 7,388,593 B2
(45) Date of Patent: Jun. 17, 2008

(54) IMAGE FORMING APPARATUS

(75) Inventor: Masahiro Fukuda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 362 days.

(21) Appl. No.: 11/217,970

(22) Filed: Sep. 1, 2005

(65) Prior Publication Data

US 2006/0050135 A1 Mar. 9, 2006

(30) Foreign Application Priority Data

Sep. 7, 2004 (JP) ..... 2004-259470

(51) Int. Cl.
*G03G 21/16* (2006.01)
*B41J 2/45* (2006.01)

(52) U.S. Cl. ..... 347/138; 347/263; 399/125

(58) Field of Classification Search ..... 347/138, 347/245, 263; 399/107, 110, 125
See application file for complete search history.

(56) References Cited

U.S. PATENT DOCUMENTS 6,038,417 A * 3/2000 Nagamine et al. ..... 399/125
7,212,221 B2 * 5/2007 Walsh et al. ..... 347/138

FOREIGN PATENT DOCUMENTS

JP 07-314779 A 12/1995
JP 2003-112446 A 4/2003

* cited by examiner

*Primary Examiner*—Huan Tran
(74) *Attorney, Agent, or Firm*—Panitch Schwarze Belisario & Nadel LLP

(57) ABSTRACT

An image forming apparatus includes LED heads protected from scratching. An optical head is mounted on an inner side of a lid pivotally mounted to a body of the apparatus. A protector is mounted to the lid. A mechanism is operatively coupled to the lid such that when the lid is positioned at an open position, the protector is at a protection position where the protector covers a light-emitting surface of the optical head and when the lid is positioned at a closed position, the protector is at an exposure position where the protector does not cover the light-emitting surface of the optical head. When the lid is pivoted from the closed position to a position at which the lid forms an angle with the body, the mechanism begins to cause the protector to move from the exposure position toward the protection position.

17 Claims, 12 Drawing Sheets

IMAGE FORMING APPARATUS

BACKGROUND OF THE INVENTION

1. Field of the Invention

The present invention relates to an image forming apparatus that employs electrophotography, and more particularly to an image forming apparatus provided with a means for protecting an optical head that serves as an exposing unit.

2. Description of the Related Art

Some conventional electrophotographic printers employ an exposing unit, commonly called an LED head. One such printer incorporates a lid pivotally assembled to a body of the printer and a process cartridge detachably installed into the body. The process cartridge includes primarily a photoconductive drum, charging unit, developing unit, and toner cartridge. The lid includes an LED head mounted on the inner surface of the lid. When the lid is completely closed, the light-emitting surface of the LED head is positioned relative to the photoconductive drum so that the LED head can properly illuminate the surface of the photoconductive drum.

The problem with the conventional electrophotographic printers is that when a lid or cover is opened to dismount a process cartridge from the apparatus, the process cartridge can contact an LED head to scratch the light-emitting surface of the LED head. Such inadvertent contact of the process cartridge with the LED head causes adverse effects to print quality.

SUMMARY OF THE INVENTION

An object of the present invention is to solve the aforementioned problems associated with conventional printers.

Another object of the present invention is to provide an image forming apparatus in which when a lid or cover is opened to dismount a process cartridge from the apparatus, a process cartridge will not contact an LED head to scratch the light-emitting surface of the LED head.

An image forming apparatus includes LED heads protected from being scratched when a lid or cover is opened to dismount a process cartridge from the apparatus. A lid is pivotally mounted to a body of an image forming apparatus. The lid is operated by the user so that the lid is positioned either at a first position where the lid closes an opening formed in the body or a second position where the lid opens the opening. An optical head is mounted on an inner side of the lid. A protection member is mounted to the lid, the protection member being positioned either at a third position where the protection member covers a light-emitting surface of the optical head or at a fourth position where the protection member does not cover the light-emitting surface of the optical head. A mechanism is operatively coupled to the lid such that when the lid is pivoted relative to the body, the mechanism causes the protection member to be positioned either at the third position or at the fourth position. When the lid is positioned at the first position, the protection member is at the fourth position. When the lid is pivoted from the first position to a position at which the lid forms an angle with the body, the mechanism begins to cause the protection member to move from the fourth position toward the third position. When the lid is positioned at the second position, the protection member is at the third position.

The mechanism includes a gear, a rack, and a gear train. The gear is rotatably supported on the lid. The rack is mounted to the body. When the lid is pivoted to a position at which the lid forms the angle with the body, the gear moves into a meshing engagement with the rack. The gear train is mounted to the body, and transmits rotation of the gear to the protection member. The lid and the protection member are operatively coupled through the gear train such that when the lid is pivoted from the first position to the second position, the protection member moves from the fourth position to the third position.

The protection member includes a first member and a second member. The first member is supported by the lid. The second member is coupled to the first member. When the protection member is at the third position, the second member being movable to a fifth position where the light-emitting surface is exposed.

The optical head is one of a plurality of optical heads that are mounted to the lid and extend in a longitudinal direction substantially perpendicular to a shaft about which the lid is pivoted.

The image forming apparatus further includes a plurality of process cartridges each of which incorporates a photoconductive drum that is illuminated by a corresponding one of the plurality of optical heads. The plurality of process cartridges are detachably attached to the body and aligned along a path in which a recording medium is transported. When the lid is at the first position, each of the plurality of optical heads is between adjacent process cartridges.

The optical head is a light emitting diode (LED) head.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
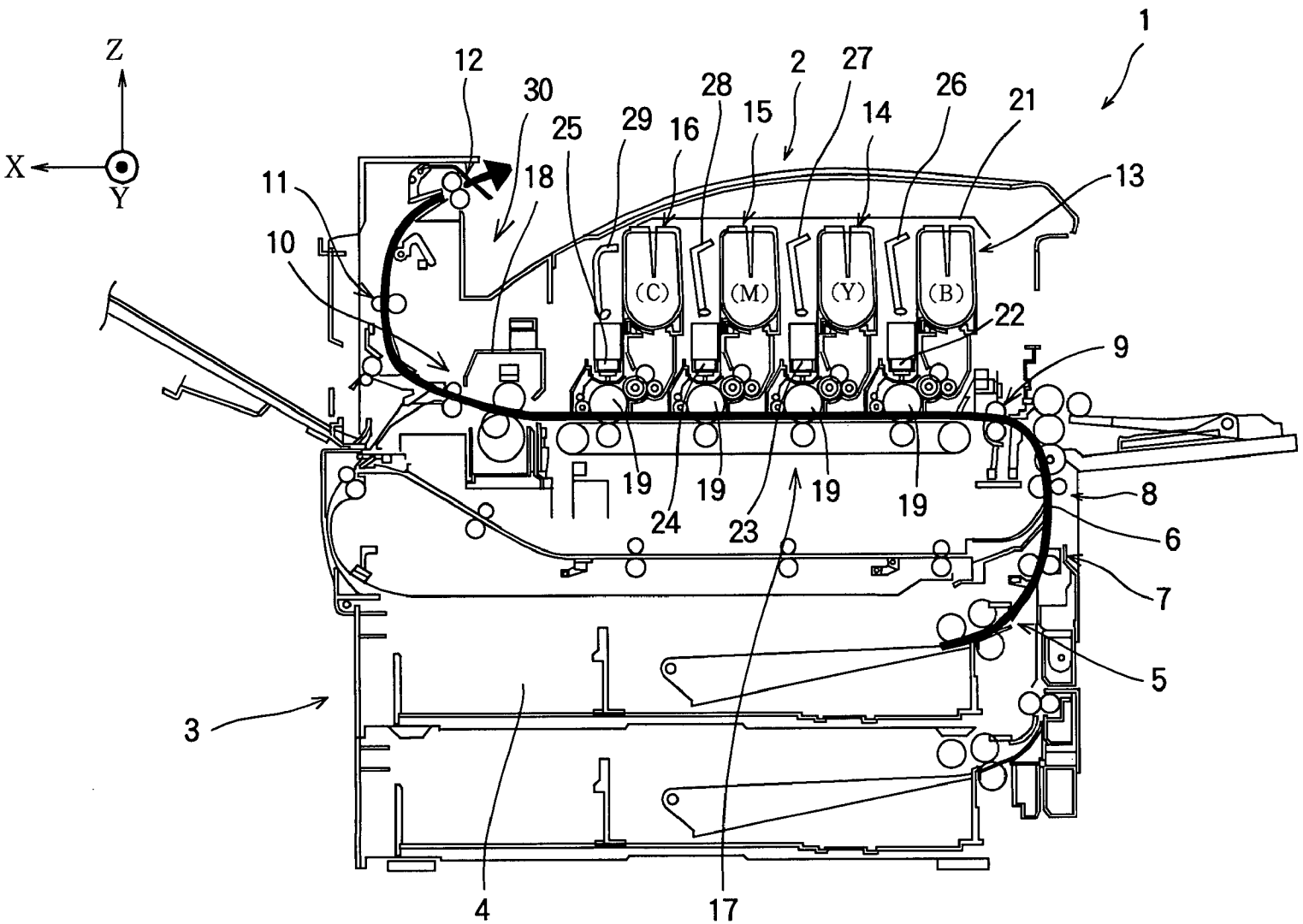
FIG. 1 is a schematic view illustrating a pertinent portion of an image forming apparatus according to a first embodiment of the invention.

FIG. 1 is a schematic view illustrating a pertinent portion of an image forming apparatus according to a first embodiment of the invention.

Referring to FIG. 1, an image forming apparatus 1 includes a body 3 and a lid 2 that pivotally attached to the body 3 (FIG. 3) to open and close an opening 20 formed in the body 3. A paper cassette 4 holds a stack of recording paper therein. A feeding section 5 feeds the recording paper at regular intervals from the paper cassette 4 into a paper-transporting path 6. Paper transporting rollers 7-12 are aligned along the paper-transporting path 6 and transport the recording paper along the paper-transporting path 6. Process cartridges 13-16 are aligned straight along the paper-transporting path 6 and detachably attached to the body 3. A transfer unit 17 includes a transfer belt that faces the process cartridges 13-16 to define a straight portion of the paper-transporting path 6. A fixing unit 18 fuses toner images on the recording paper into a permanent image.

The lid 2 is formed with a head mounting section 21 on its inner side. The head mounting section 21 is formed in the vicinity of the photoconductive drums 19 in the process cartridges 13-16. The head mounting section 21 supports LED heads 22-25 and LED shutters 26-29 that cover the LED heads 22-25 by means of a later described mechanism.

An X-axis denotes a direction in which the recording paper passes through the process cartridges 13-16. A Y-axis denotes a direction in which the rotational axis of the photoconductive drums 19 extends. A Z-axis denotes a direction that is perpendicular to both the axes X and Y. The X-, Y-, and Z-axes also apply to other figures.

{Operation}

The operation of pertinent portions of the image forming apparatus 1 of the aforementioned configuration will be described.

The recording paper held in the paper cassette 4 is fed by the feeding section 5 into the transporting path 6 and is transported by the paper transporting rollers 7-9 to the process cartridge 13. The belt of the transfer unit 17 transports the recording paper through the process cartridges 13-16 sequentially, so that toner images of black (B), yellow (Y), magenta (M) and cyan (C) are transferred onto the recording paper in sequence. Then, the recording paper reaches the fixing unit 18. After fixing, the recording paper is advanced by the paper transporting rollers 10, 11, and 12 to a stacker 30 formed on an outside surface of the image forming apparatus 1.

A description will be given of the head mounting section 21 and a supporting mechanism that rotatably supports the head mounting section 21.

Figure 2:
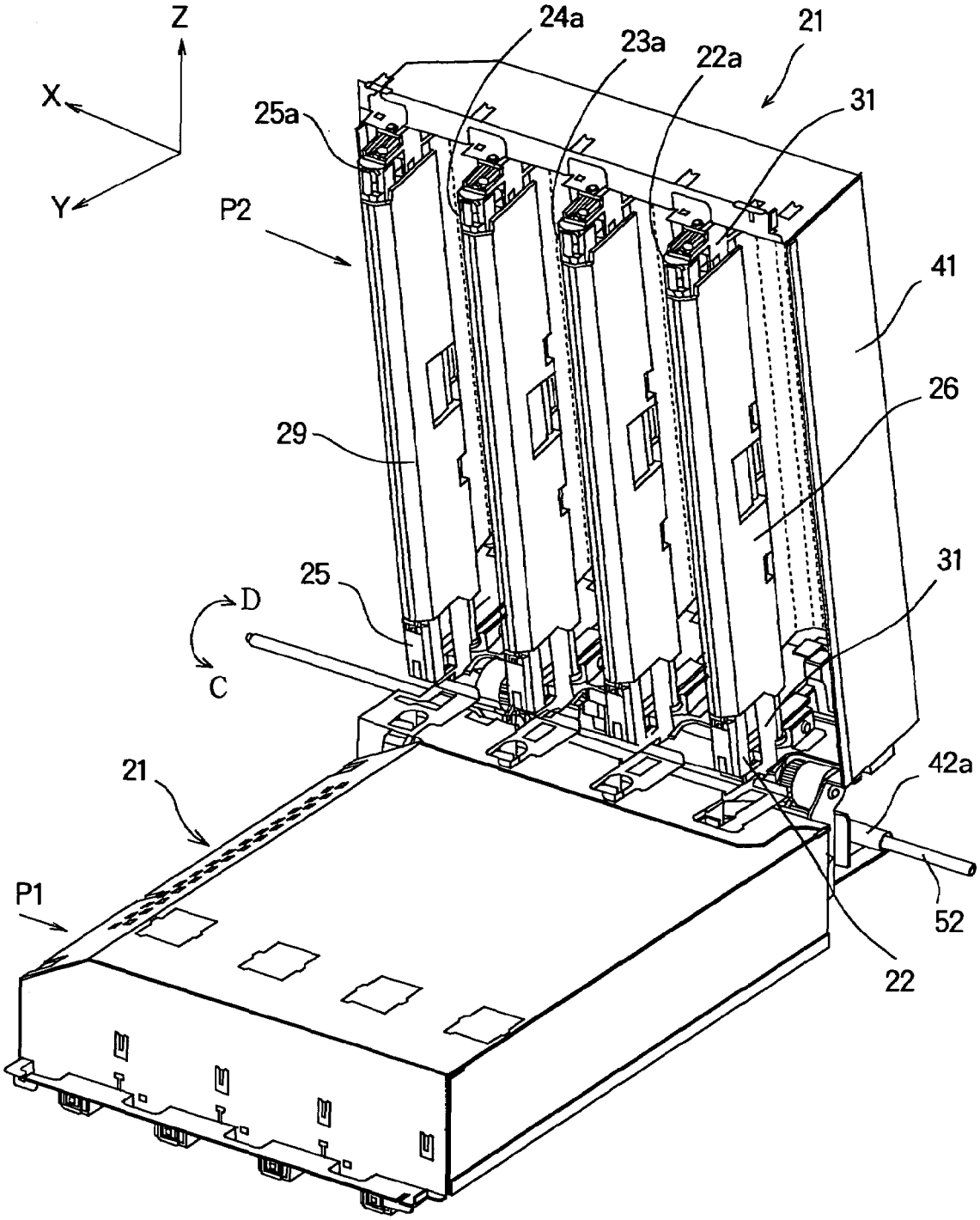
FIG. 2 is a perspective view of a head mounting section and a supporting mechanism.
Figure 3:
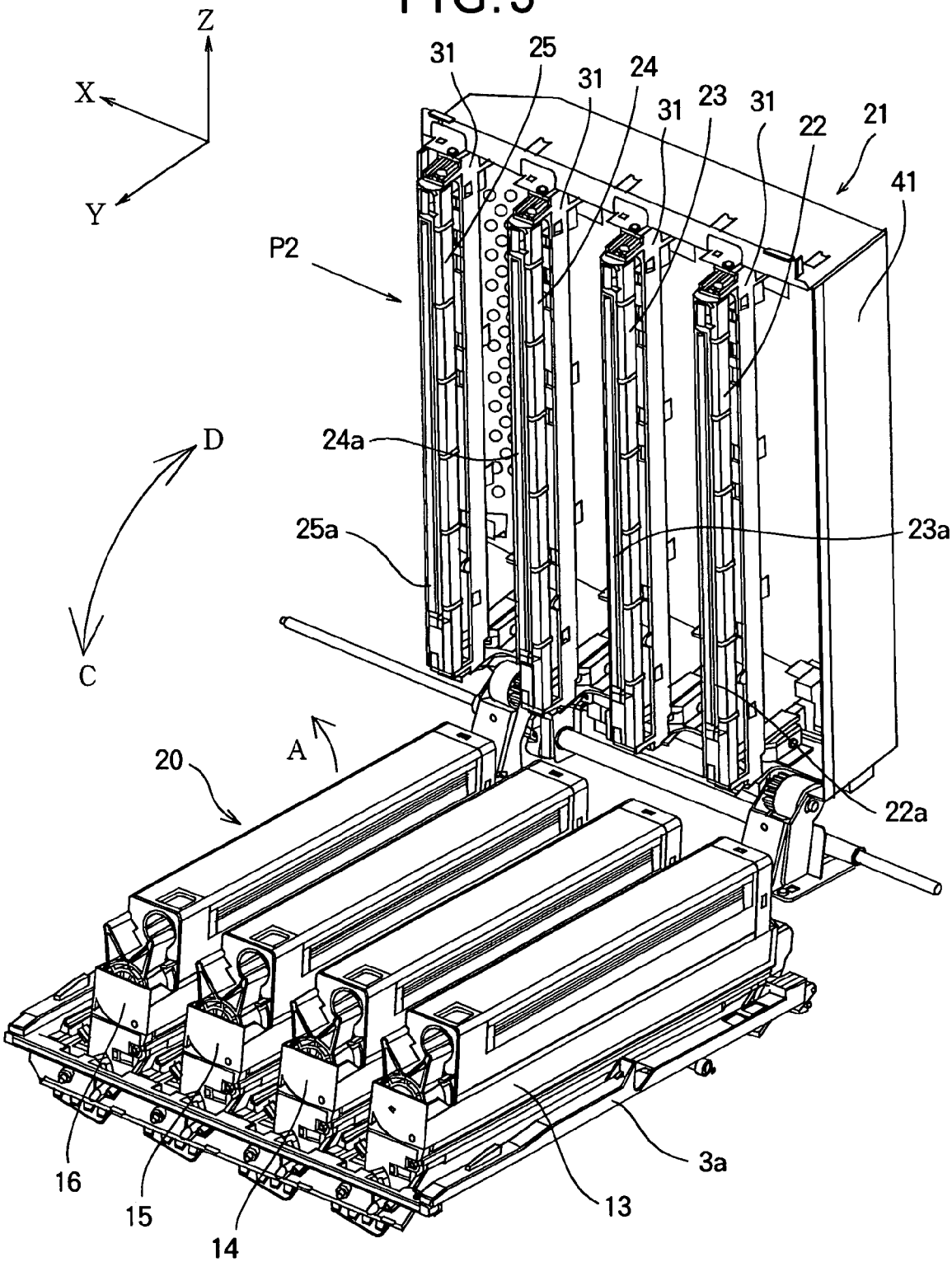
FIG. 3 illustrates the head mounting section, LED heads, and process cartridges when the head mounting section is at an open position.

FIG. 2 is a perspective view of the head mounting section 21 and the supporting mechanism that rotatably supports the head mounting section 21 both when the head mounting section 21 is at a closed position P1 to close the opening 20 (FIG. 3) and when the head mounting section 21 is at an open position P2 to open the opening 20. The head mounting section 21 is either at the closed position P1 or at the open position P2 depending on whether the mounting section 21 is closed or opened. FIG. 3 illustrates the head mounting section 21, LED heads 22-25, and the entire process cartridges 13-16 when the head mounting section 21 is at the open position P2. For convenience of explanation, the LED shutters 26-29 are not shown.

Referring to FIG. 3, the process cartridges 13-16 are oriented so that the rotational axes of the photoconductive drums 19 are parallel to the Y-axis. The process cartridges 13-16 for toner images (B), (Y), (M), and (C) are aligned at regular intervals in a direction parallel to the X-axis. The process cartridges 13-16 are detachably mounted to a basket 3*a* of the body 3. The process cartridges 13-16 can be detached from the body 3 by pulling them up in a direction shown by arrow A.

The LED heads 22-25 are mounted to the head mounting section 21 by way of a head holder 31 and extend in such directions as to lie adjacent to the corresponding process cartridges 13-16 when the head mounting section 21 is at the closed position. When the head mounting section 21 is at the closed position P1, light-emitting surfaces 22*a*-25*a* of the LED heads 22-25 are close to the circumferential surfaces of the corresponding photoconductive drums 19. The LED heads 22-24 lie between adjacent process cartridges 13-16.

Figure 4:
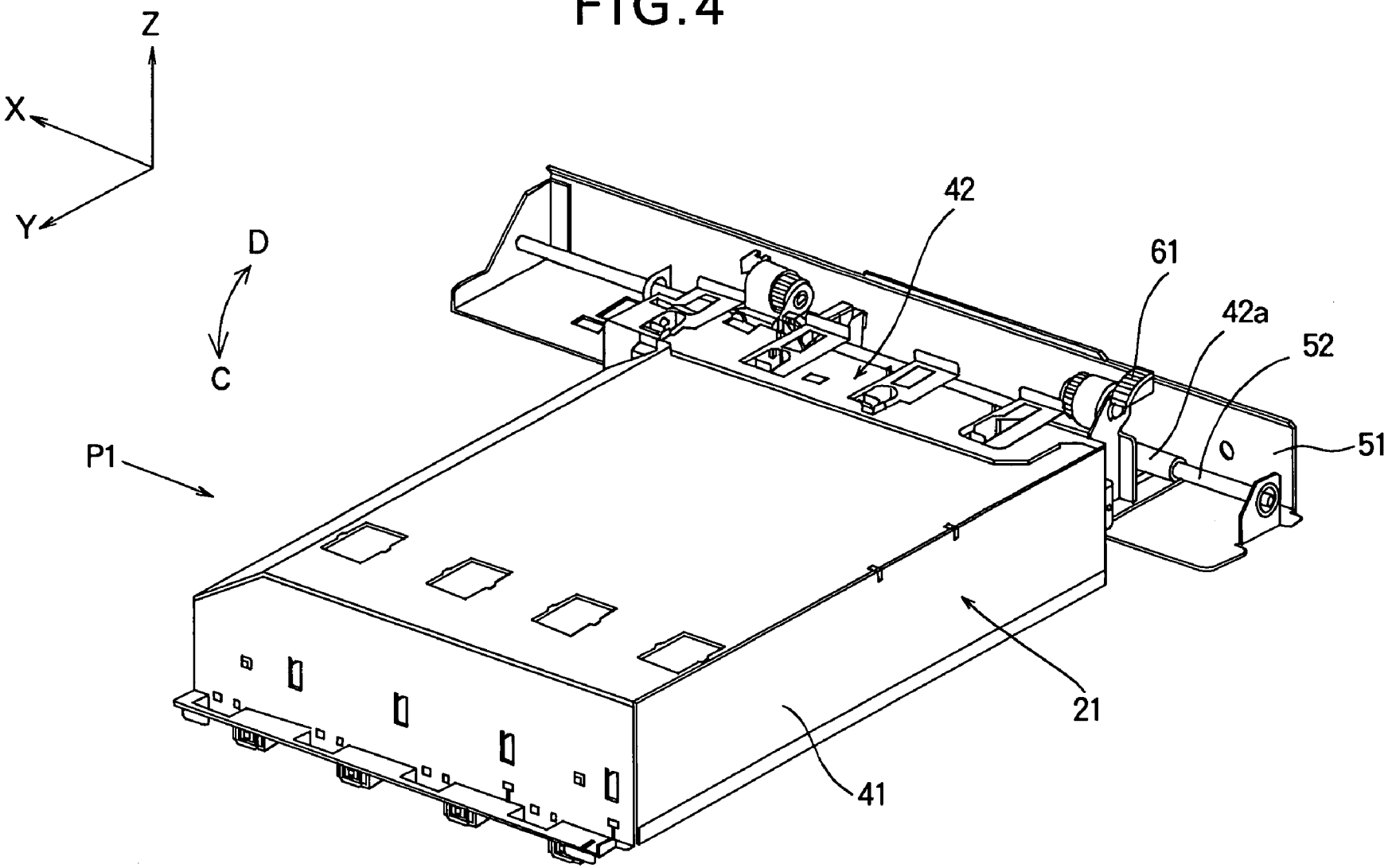
FIG. 4 illustrates the head mounting section when it is at a closed position.
Figure 5:
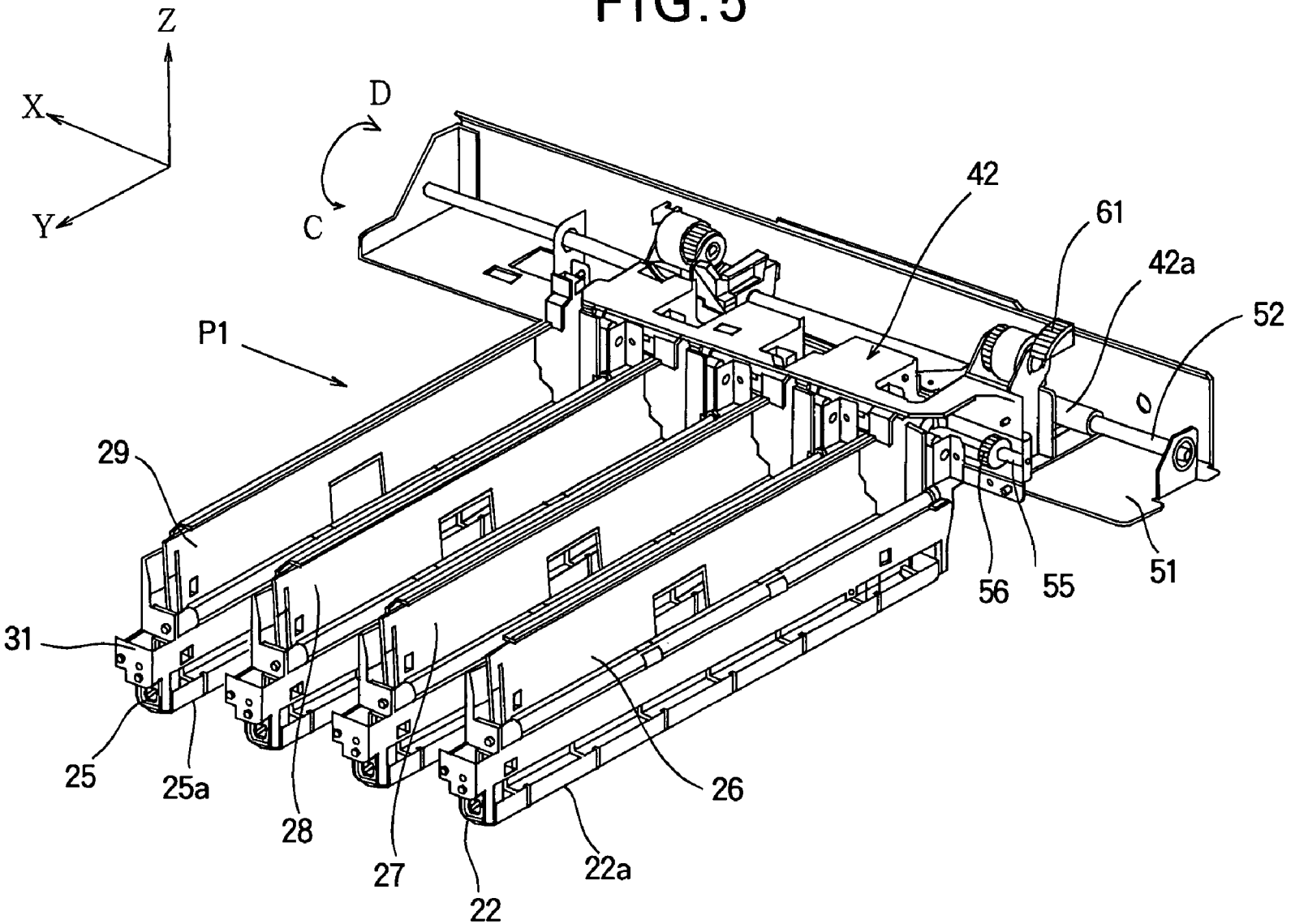
FIG. 5 illustrates the LED heads with a top cover removed when the head mounting section is at the closed position.

FIG. 4 and FIG. 5 illustrate the supporting mechanism that supports the head mounting section 21. FIG. 4 illustrates the head mounting section 21 when it is at the closed position P1. FIG. 5 illustrates the LED heads with a top cover removed when the head mounting section 21 is at the closed position P1.

A bracket 51 is fixed to the body 3 and rotatably supports a shaft 52. A coupling 42 and a side wall 41*a* (FIG. 6) are joined together. A free end 42*a* (FIG. 4) of the coupling 42 is fixed to the shaft 52. Thus, the head mounting section 21 is pivotal about the shaft 52 between the closed position P1 and the open position P2 in directions shown by arrows C and D. The LED shutters 26-29 rotate in such a way that when the head mounting section 21 is at the open position P2 as shown in FIG. 2, The LED shutters 26-29 cover the light-emitting surfaces 22*a*-25*a* of the LED heads 22-25. The LED shutters 26-29 rotate in such a way that when the head mounting section 21 is at the closed position P1 as shown in FIG. 5, the head mounting section 21 uncovers the light-emitting surfaces 22*a*-25*a*.

{Opening/Closing Mechanism for Shutters}

Figure 6:
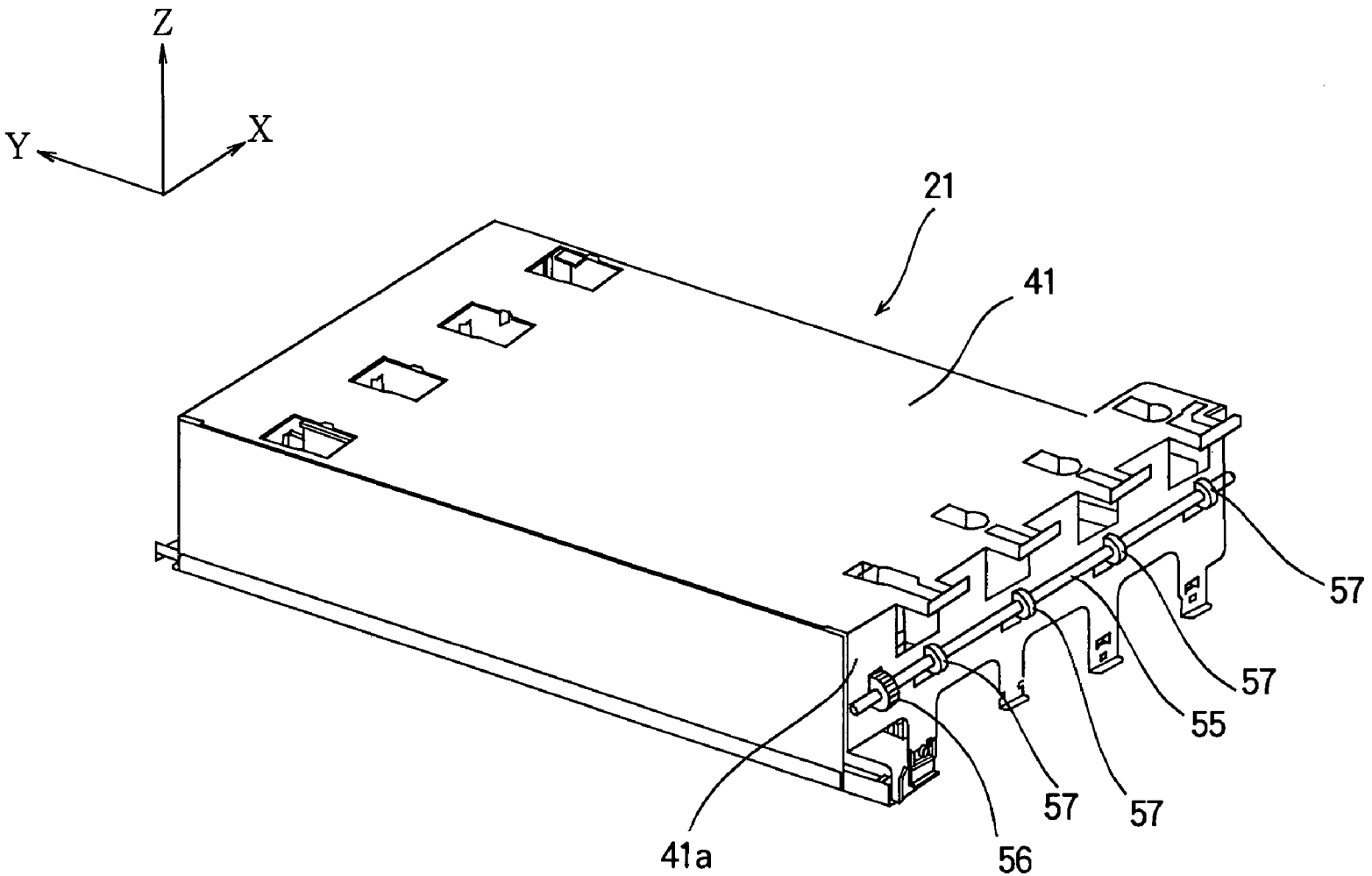
FIG. 6 is a perspective view illustrating the arrangement of a shaft relative to the head mounting section.
Figure 7:
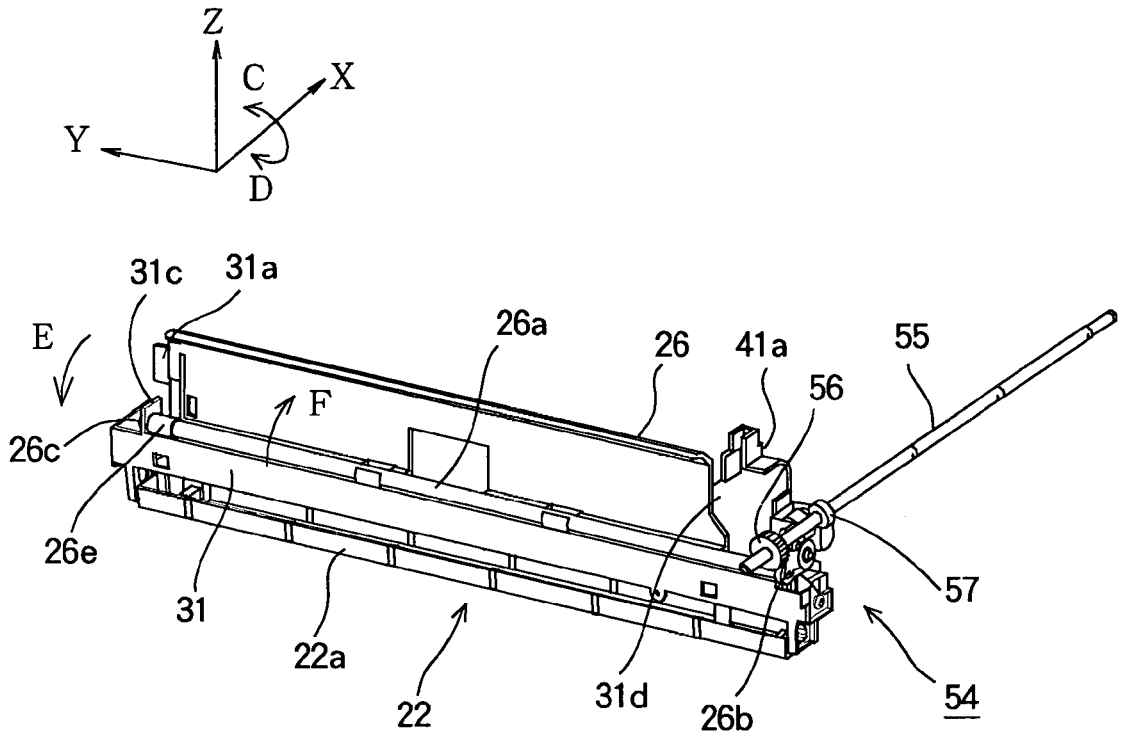
FIG. 7 and FIG. 8 illustrate an LED shutter and an opening/closing mechanism that causes the LED shutter to open and close.
Figure 8:
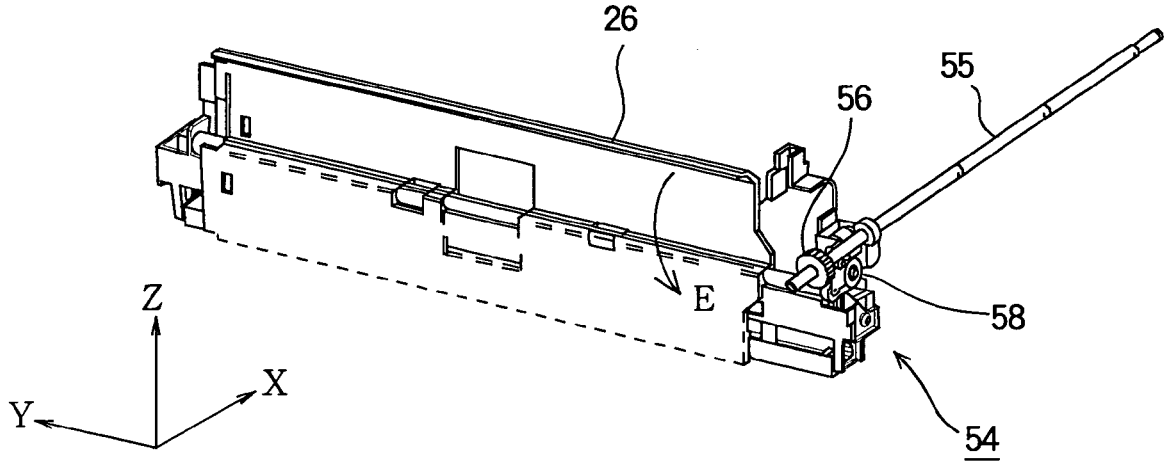
Figure 9:
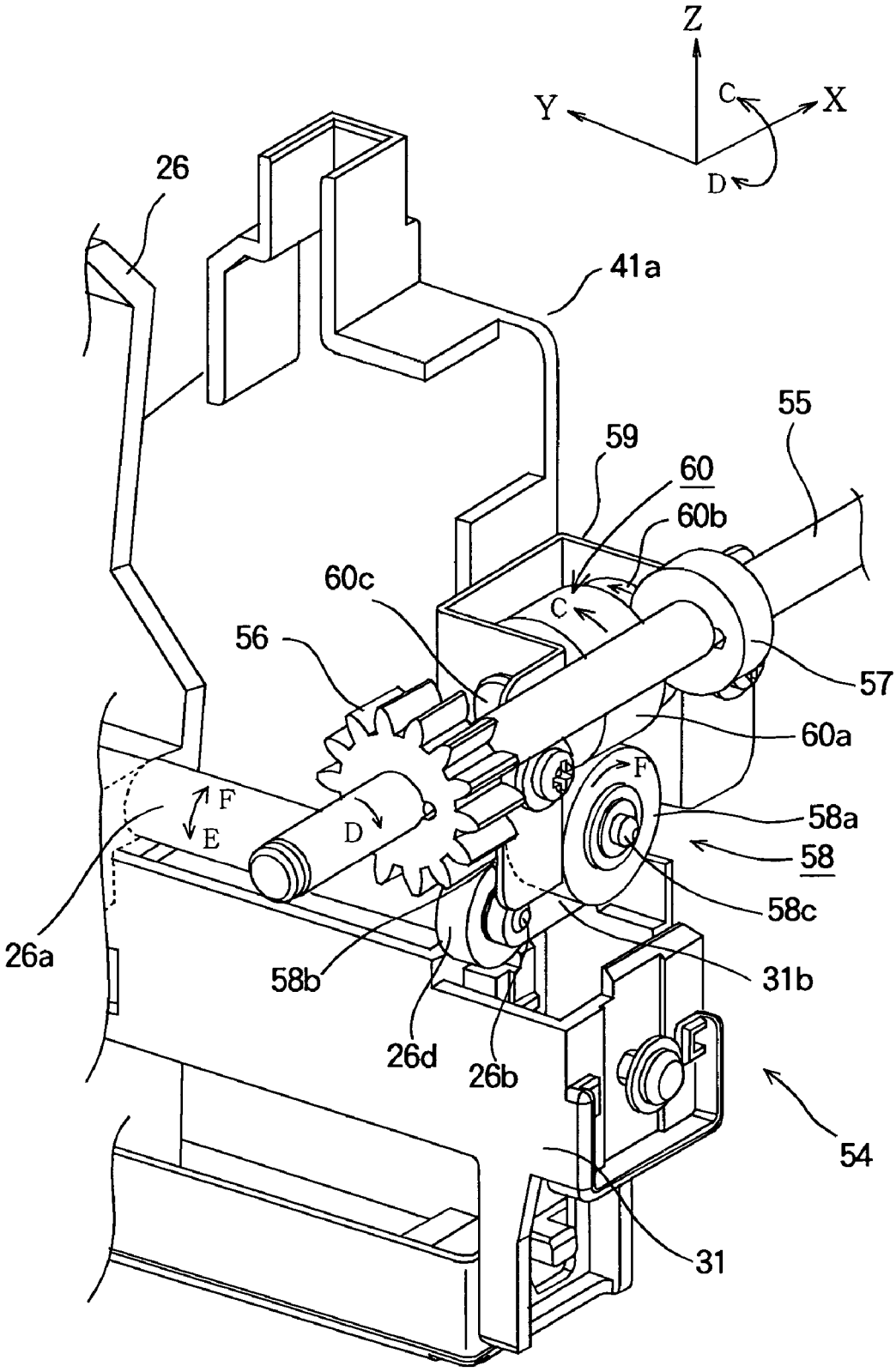
FIG. 9 is an enlarged view of the vicinity of a gear in FIG. 8.

An opening/closing mechanism for the LED shutters 26-29 will be described. FIG. 6 is a perspective view illustrating the arrangement of a shaft 55 relative to the head mounting section 21. FIGS. 7 and 8 illustrate the operation and configuration of the opening/closing mechanism. FIG. 9 is an enlarged view of the vicinity of a gear 56 in FIG. 8. The X-, Y-, and Z-axes are oriented in the same directions as those in FIG. 1.

As shown in FIG. 6, the shaft 55 has four gears 57 fixedly mounted at positions corresponding to the LED shutters 26-29, respectively, and the gear 56 mounted to one longitudinal end portion of the shaft 55.

Referring to FIG. 5, the coupling 42 supports the shaft 55 at the connection of a top cover 41 and the coupling 42 in such a way that the shaft 55 extends in the X-axis and is rotatable. The bracket 51 has a rack 61 that extends in a path in which the gear 56 moves when the coupling 42 rotate about the shaft 52 in the D direction. When the user causes the head mounting section 21 to pivot in the D direction, the coupling 42 rotates about the shaft 52 through a predetermined angle θ1, so that the gear moves into a meshing engagement with the rack 61.

FIG. 7 and FIG. 8 illustrate the LED shutter 26 and an opening/closing mechanism 54 that causes the LED shutter 26 to open and close. The opening/closing mechanism 54 is provided on each of the LED shutters 26-29. The opening/closing mechanisms 54 are of the same configuration and the one provided for the LED shutter 26 will be described by way of example.

Referring to FIG. 7, the LED shutter 26 is mounted on a shaft 26*a*. The shaft 26*a* is rotatably supported at its longitudinal ends 26*b* (FIG. 9) and 26*c* by the supporting portions 31*b* (FIG. 9) and 31*c* of the head holder 31. A torsion spring 26*e* is mounted on one longitudinal end portion of the shaft 26*a*. The torsion spring 26*e* urges the LED shutter 26 in a direction shown by arrow F, so that the LED shutter 26 is maintained at a position where the LED shutter 26 abuts limiters 31*a* and 31*d* and the entire LED head 22 is exposed.

Referring to FIG. 9, a shutter gear 26*d* is mounted on one longitudinal end portion of the shaft 26*a*. The first intermediate gear 58 includes a helical gear 58*a* and the spur gear 58*b* concentrically mounted on a shaft 58*c*. The shutter gear 26*d* is in a meshing engagement with the spur gear 58*b*. The shaft 58*c* extends in the Y-axis perpendicular to the X-axis, and is rotatably supported on the side wall 41*a* (FIG. 6) of the top cover 41 and a bracket 59 fixed to the side wall 41*a*. The helical gear 58*a* is in a meshing engagement with another helical gear 60*a* of a second intermediate gear 60. The second intermediate gear 60 has a shaft 60*c* that extends in a direction parallel to the X-axis and is rotatably supported on the bracket 59 fixed to the side wall 41*a*. The second intermediate gear 60 has a spur gear 60*b* in a meshing engagement with a gear 57 fixedly mounted to the shaft 55.

As is clear from FIG. 9, when the shaft 55 rotates in the D direction, the helical gear 60*a* rotates in the C direction. Thus, the rotation of the second intermediate gear 60 is transmitted to the first intermediate gear 58 through the helical gear 58*a*, so that the first intermediate gear 58 rotates in the F direction. The rotation of the first intermediate gear 58 in the F direction is then transmitted to the shutter gear 26*d* through the spur gear 58*b*, so that the shaft 26*a* rotates in a direction shown by arrow E. Thus, the shutter 26 begins to rotate against the urging force of the torsion spring 26*e* (FIG. 7) in the E direction, from the exposure position where the shutter 26 abuts the limiters 31*a* and 31*d* to the protection position (dotted lines in FIG. 8) where the shutter 26 covers the light-emitting surfaces of the LED head 22.

{Interlocked Operation of Head Mounting Section and LED Shutter}

A description will now be given of the operation of the LED shutter 26 in which the LED shutter 26 rotates in the C and D directions between the closed position P1 and the open position P2.

When the head mounting section 21 is at the closed position P1 (FIG. 2), the head mounting section 21 is at the position where the head mounting section 21 abuts the limiters 31*a* and 31*d*, i.e., the exposure position where the entire LED head 22 is exposed. FIG. 5 illustrates the LED shutters 26-29 on the head mounting section 21 with the top cover 41 (FIG. 4) omitted. When the head mounting section 21 is opened in the D direction from the position in FIG. 5, the head mounting section 21 begins to pivot about the shaft 52. After the head mounting section 21 has rotated through an angle from the closed position P1, the gear 56 moves into a meshing engagement with the rack 61.

{Operation of Gear and Rack}

Figure 10:
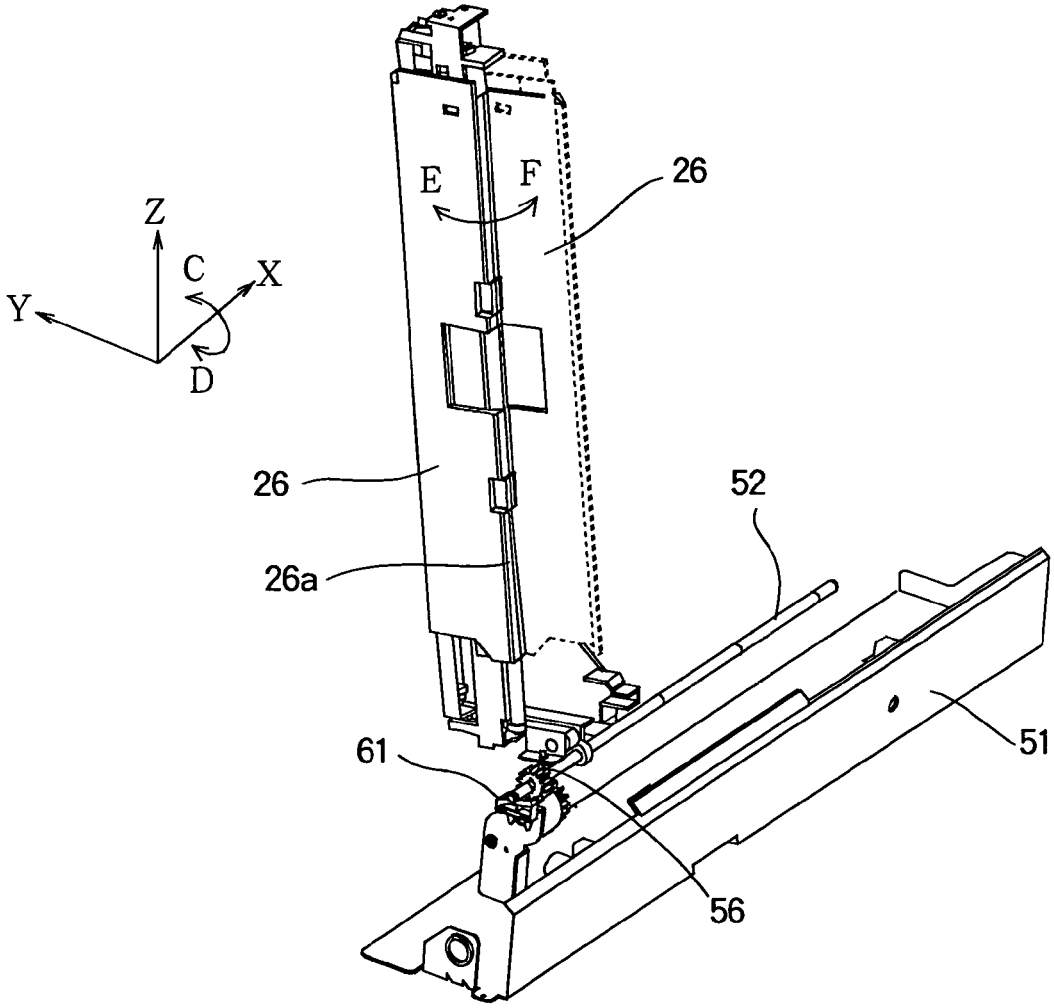
FIG. 10 is a perspective view illustrating the operation of the gear and a rack.
Figure 11:
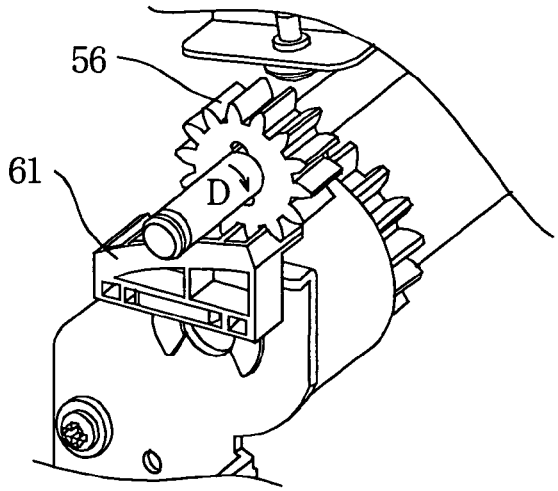
FIG. 11 is an enlarged perspective view of a pertinent portion in FIG. 10.

FIG. 10 is a perspective view illustrating the operation of the gear 56 and the rack 61. FIG. 11 is an enlarged perspective view of a pertinent portion in FIG. 10.

When the head mounting section 21 further rotates in the D direction after the gear 56 has moved into a meshing engagement with the rack 61, the gear 56 begins to rotate in the D direction as shown in FIG. 11. The movement of the gear 56 in the D direction causes the shaft 26*a* and LED shutter 26 to gradually rotate against the urging force of the torsion spring 26*e* (FIG. 7) in the E direction. Thus, When the head mounting section 21 reaches the open position P2 (FIG. 2), the LED shutter 26 will have rotated through about 180 degrees from the exposure position (dotted lines) to the protection position (solid lines) in FIG. 10.

When the head mounting section 21 rotates in the C direction from the open position P2 (FIG. 2) where the LED shutter 26 is at the protection position toward the closed position (FIG. 2), the gear 56 rotates in the C direction while remaining in a meshing engagement with the rack 61. The rotation of the gear 56 in the C direction causes the shaft 26*a* and the LED shutter 26 to rotate in the F direction. When the head mounting section 21 has rotated through a certain angle so that the gear 56 moves out of a meshing engagement with the rack 61, the LED shutter 26 will have rotated through about 180 degrees in the F direction from the protection position to the exposure position. Then, the urging force of the torsion spring 26 continues to maintain the LED shutter 26 at the exposure position.

Because, when the lid is opened, the LED shutter covers the light-emitting surfaces of the LED, thereby preventing inadvertent contact or interference of the light-emitting surfaces of the LED head with the process cartridge during the replacement of the process cartridge. The configuration not only prevents damage to the light-emitting surfaces but also provides stable printing.

The LED heads extend in the directions substantially perpendicular to the rotational axis of the lid. Therefore, when the head mounting section is pivoted, one longitudinal ends of the LED heads first approaches the rotational axis and then the other longitudinal ends gradually enter spaces between adjacent process cartridges. Thus, if the LED shutter begins to rotate before the lid has opened sufficiently, the LED shutter will interfere with the body 3. However, because the LED shutter begins to rotate after the lid has opened sufficiently, the LED shutter will not interfere with the body 3.

A tandem type image forming apparatus includes a plurality of LED heads and process cartridges aligned. In order to design a compact image forming apparatus, it is desirable that the process cartridges are closely spaced and the LED heads are accommodated and moved in a minimum space. The LED shutter according to the embodiment begins to rotate only after the lid has been opened sufficiently. Therefore, a large space is not necessary for preventing the LED shutter from interfering with the various portions of the image forming apparatus during the pivotal movement of the LED shutter.

Second Embodiment

Figure 12:
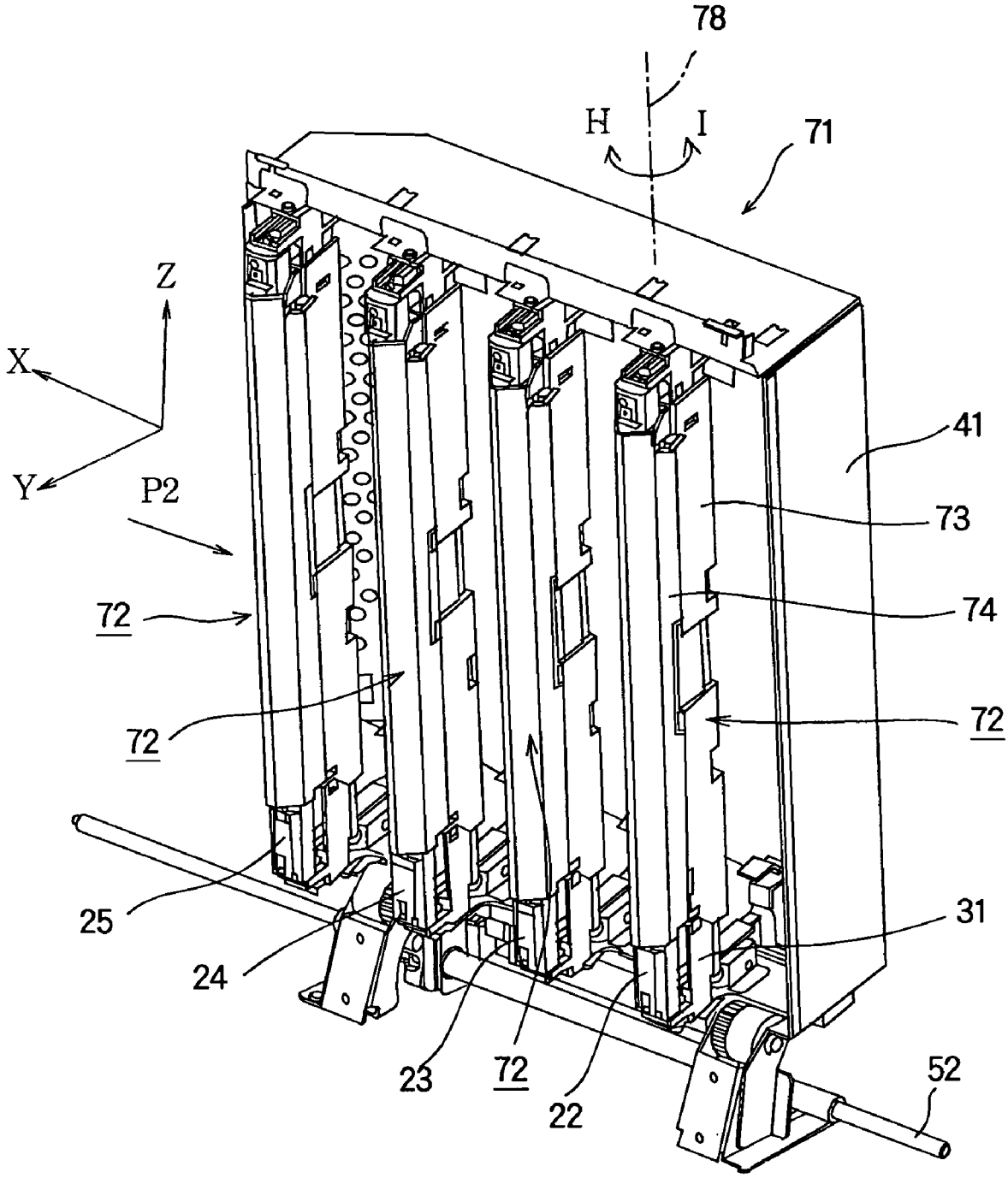
FIG. 12 is a perspective view illustrating a pertinent portion of a head mounting section employed in an image forming apparatus according to a second embodiment.

FIG. 12 is a perspective view illustrating a pertinent portion of a head mounting section 71 employed in an image forming apparatus according to a second embodiment.

The head mounting section 71 differs from the head mounting section 21 in the configuration of LED shutters 72 disposed corresponding to LED heads 22-25. An opening/closing mechanism for the LED shutters 72 is the same as the first embodiment. The elements similar to those in the first embodiment have been given the same or similar reference numerals and the description thereof is omitted. The LED shutters 72 are of the same configuration and the one provided for the LED head 22 will be described by way of example. A description will be given of a portion different from the first embodiment.

Figure 14:
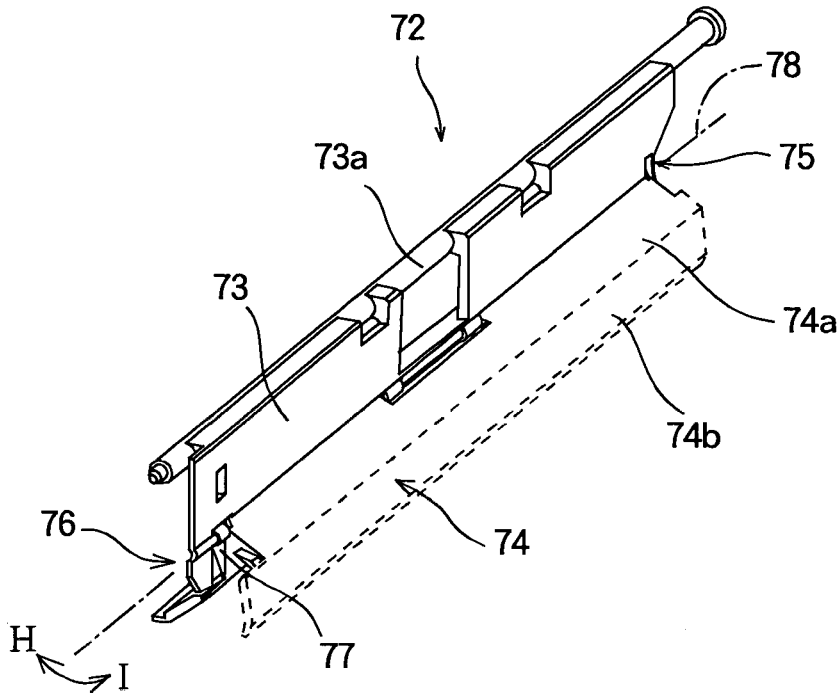
FIG. 14 is a perspective view illustrating an LED shutter as seen from the front.
Figure 15:
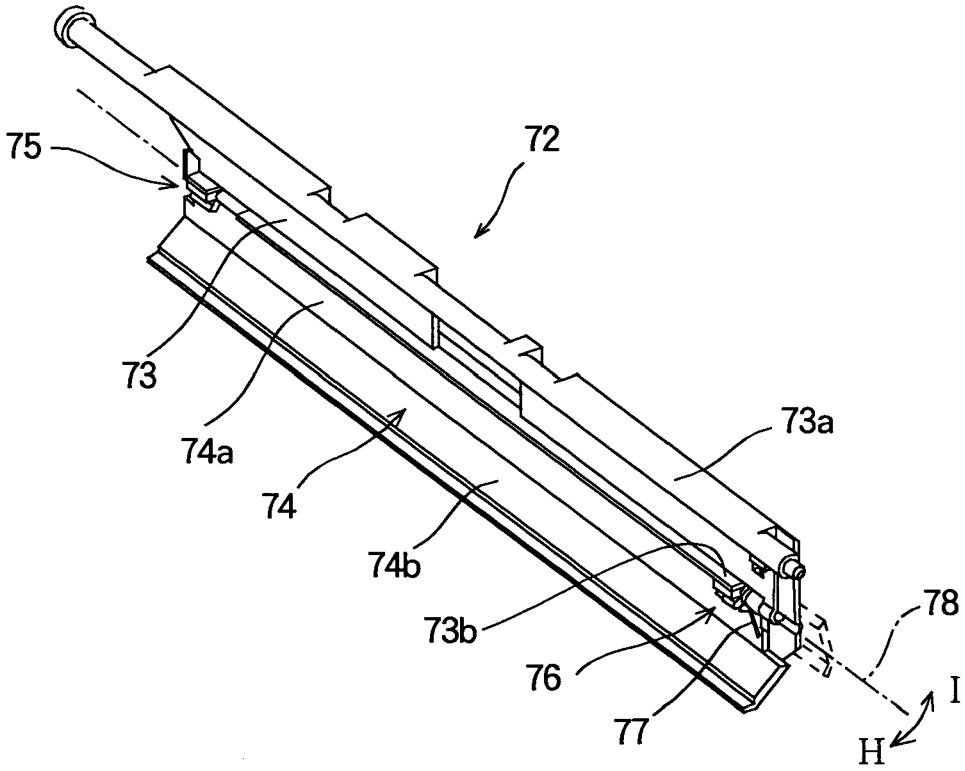
FIG. 15 is a perspective view illustrating the LED shutter as seen from the back.

Referring to FIG. 12, the LED shutter 72 includes a first shutter 73 and a second shutter 74. The second shutter 74 is rotatable relative to the first shutter 73. FIGS. 14 and 15 are perspective views of the LED shutter 72. FIG. 14 illustrates the LED shutter 72 as seen from the front and FIG. 15 illustrates the LED shutter 72 as seen from the back.

Referring to FIG. 14 and FIG. 15, a shaft 73*a* is formed integral with the first shutter 73. The first shutter 73 and the second shutter 74 are coupled to each other through hinges 75 and 76, so that the second shutter 74 is rotatable about an axis 78 relative to the first shutter 73. A torsion spring 77 is mounted between the first shutter 73 and the second shutter 74 to urge the second shutter 74 in a direction shown by arrow H, and a limiter 73*b* formed on the first shutter 73 restricts the rotation of the second shutter 74.

If no external force acts on the second shutter 74, the torsion spring 77 and the limiter 73*b* cooperate to hold the second shutter 74 at a normal position (solid line position in FIGS. 14 and 15) where a side wall 74*a* of second shutter 74 is in substantially the same plane as the first shutter 73 and an edge portion 74*b* extending at an angle with the side wall 74*a* covers the light-emitting surface 22*a* of the LED head 22.

When the LED shutter 72 is at the normal position, the LED shutter 72 operates in exactly the same manner as the LED shutter 26 in the first embodiment. Referring to FIG. 12, the LED shutter 72 is in the normal position, the head mounting section 71 is at the open position P2 where the opening 20 of the body 3 is not closed, and the LED shutter 72 has rotated to the protection position where the LED shutter 72 covers the light-emitting surface 22*a* of the LED head 22.

Referring to FIG. 12, if the operator opens the second shutter 74 in a direction shown by arrow I so that the second shutter 74 rotates about the axis 78, the second shutter 74 rotates in the I direction against the urging force of the torsion spring 77 (FIGS. 14 and 15) to reach a dotted line position in FIG. 14.

Figure 13:
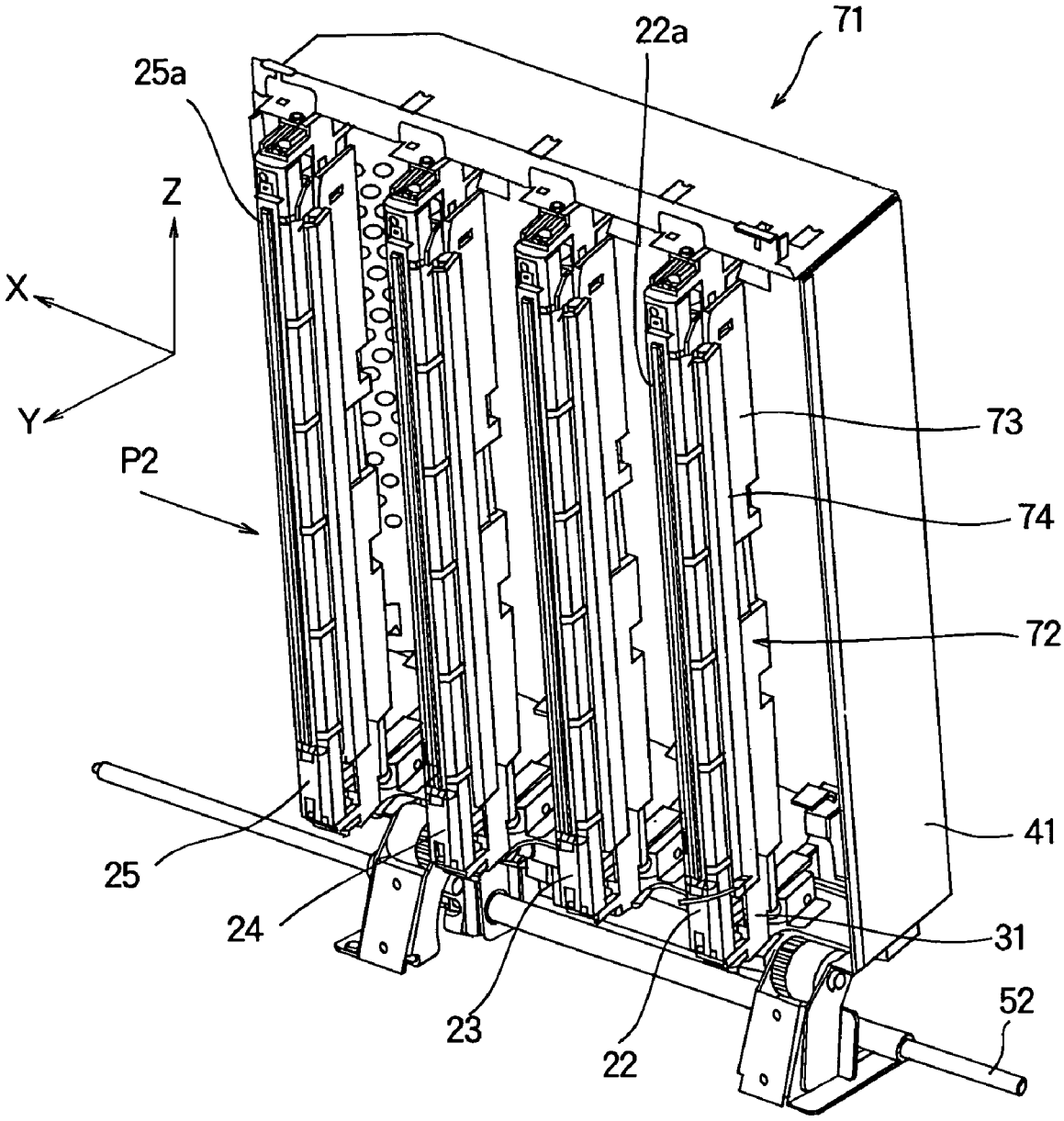
FIG. 13 illustrates when a second shutter has rotated to a dotted line position in FIG. 14.

FIG. 13 illustrates when the second shutter 74 has rotated to the dotted line position in FIG. 14. Even when the head mounting section 71 is at the open position P2 where the LED shutters 72 cover the light-emitting surfaces 22*a*-25*a*, the operator can rotate the second shutters 74 manually when the maintenance of the apparatus is performed, so that the LED heads 22-25 are exposed. Because the torsion spring 77 urges the second shutter 74 at all times in the H direction, the second shutter 74 can return to the normal position in FIG. 12 once the operator releases the second shutter 74.

As described above, the second embodiment provides the same advantages as the first embodiment. Further, even when the LED shutter 72 is at the protection position where the LED shutter 72 covers the light-emitting surfaces of the LED heads 22-25, the LED head may be exposed as required so that the maintenance works such the cleaning of the light-emitting surfaces of the LED head can be performed easily.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus comprising:

a body;

a lid pivotally mounted to said body, said lid being positioned either at a first position where said lid closes an opening formed in said body or a second position where said lid opens the opening;

an optical head mounted on an inner side of said lid;

a protection member mounted to said lid, said protection member being positioned either at a third position where said protection member covers a light-emitting surface of said optical head or at a fourth position where said protection member does not cover the light-emitting surface of said optical head;

a mechanism operatively coupled to said lid such that when said lid is pivoted relative to said body, said mechanism causes said protection member to be positioned either at the third position or at the fourth position;

wherein when said lid is positioned at the first position, said protection member is at the fourth position;

wherein when said lid is pivoted from the first position to a position at which said lid forms an angle with said body, said mechanism begins to cause said protection member to move from the fourth position toward the third position;

wherein when said lid is positioned at the second position, said protection member is at the third position.

2. The image forming apparatus according to claim 1, wherein said mechanism comprises:

a gear rotatably supported on said lid;

a rack mounted to said body, wherein when said lid is pivoted to a position at which said lid forms the angle with said body, said gear moves into a meshing engagement with said rack;

a gear train mounted to said body, said gear train transmitting rotation of said gear to said protection member;

wherein said lid and said protection member are operatively coupled through said gear train such that when said lid is pivoted from the first position to the second position, said protection member moves from the fourth position to the third position.

3. The image forming apparatus according to claim 2, wherein said protection member includes:

a first member supported by said lid;

a second member coupled to said first member, wherein when said protection member is at the third position, said second member being movable to a fifth position where the light-emitting surface is exposed.

4. The image forming apparatus according to claim 3, wherein said optical head is one of a plurality of optical heads that are mounted to said lid and extend in a longitudinal direction substantially perpendicular to a shaft about which said lid is pivoted.

5. The image forming apparatus according to claim 4, further comprising:

a plurality of process cartridges each of which incorporates a photoconductive drum that is illuminated by a corresponding one of the plurality of optical heads, said plurality of process cartridges being detachably attached to said body and aligned along a path in which a recording medium is transported;

wherein when said lid is at the first position, each of the plurality of optical heads is between adjacent process cartridges.

6. The image forming apparatus according to claim 5, wherein said optical head is a light emitting diode head.

7. The image forming apparatus according to claim 2, wherein said optical head is one of a plurality of optical heads that are mounted to said lid and extend in a longitudinal direction substantially perpendicular to a shaft about which said lid is pivoted.

8. The image forming apparatus according to claim 7, further comprising:

a plurality of process cartridges each of which incorporates a photoconductive drum that is illuminated by a corresponding one of the plurality of optical heads, said plurality of process cartridges being detachably attached to said body and aligned along a path in which a recording medium is transported;

wherein when said lid is at the first position, each of the plurality of optical heads is between adjacent process cartridges.

9. The image forming apparatus according to claim 8, wherein said optical head is a light emitting diode head.

10. The image forming apparatus according to claim 1, wherein said protection member includes:

a first member supported by said lid;

a second member coupled to said first member, wherein when said protection, member is at the third position, said second member being movable to a fifth position where the light-emitting surface is exposed.

11. The image forming apparatus according to claim 10, wherein said optical head is one of a plurality of optical heads that are mounted to said lid and extend in a longitudinal direction substantially perpendicular to a shaft about which said lid is pivoted.

12. The image forming apparatus according to claim 11, further comprising:

a plurality of process cartridges each of which incorporates a photoconductive drum that is illuminated by a corresponding one of the plurality of optical heads, said plurality of process cartridges being detachably attached to said body and aligned along a path in which a recording medium is transported;

wherein when said lid is at the first position, each of the plurality of optical heads is between adjacent process cartridges.

13. The image forming apparatus according to claim 12, wherein said optical head is a light emitting diode head.

14. The image forming apparatus according to claim 1, wherein said optical head is one of a plurality of optical heads that are mounted to said lid and extend in a longitudinal direction substantially perpendicular to a shaft about which said lid is pivoted.

15. The image forming apparatus according to claim 14, further comprising:

a plurality of process cartridges each of which incorporates a photoconductive drum that is illuminated by a corresponding one of the plurality of optical heads, said plurality of process cartridges being detachably attached to said body and aligned along a path in which a recording medium is transported;

wherein when said lid is at the first position, each of the plurality of optical heads is between adjacent process cartridges.

16. The image forming apparatus according to claim 15, wherein said optical head is a light emitting diode head.

17. An image forming apparatus comprising:

a body;

a lid pivotally mounted to said body, said lid being positioned either at a first position where said lid closes an opening formed in said body or a second position where said lid opens the opening;

a light emitting diode head mounted on an inner side of said lid;

a protection member mounted to said lid, said protection member being positioned either at a third position where said protection member covers a light-emitting surface of said light emitting diode head or at a fourth position where said protection member does not cover the light-emitting surface of said light emitting diode head;

a mechanism operatively coupled to said lid such that when said lid is pivoted, said mechanism causes said protection member to be positioned either at the third position or at the fourth position;

wherein when said lid is closed at the first position, said protection member is at the fourth position;

wherein when said lid is pivoted from the first position to a position at which said lid forms an angle with said body, said mechanism begins to cause said protection member to move from the fourth position toward the third position;

wherein when said lid is pivoted to the second position, said protection member is at the third position.

* * * * *